US008333075B2

(12) United States Patent
York et al.

(10) Patent No.: US 8,333,075 B2
(45) Date of Patent: Dec. 18, 2012

(54) GAS TURBINE PREMIXER WITH INTERNAL COOLING

(75) Inventors: William David York, Greer, SC (US); Thomas Edward Johnson, Greer, SC (US); Benjamin Paul Lacy, Greer, SC (US); Christian Xavier Stevenson, Greenville, SC (US)

(73) Assignee: General Electric Company, Schenectady, NY (US)

( * ) Notice: Subject to any disclaimer, the term of this patent is extended or adjusted under 35 U.S.C. 154(b) by 916 days.

(21) Appl. No.: 12/425,293

(22) Filed: Apr. 16, 2009

(65) Prior Publication Data

US 2010/0263383 A1 Oct. 21, 2010

(51) Int. Cl.
*F02C 7/22* (2006.01)

(52) U.S. Cl. ..... 60/748; 60/737; 60/740; 60/742; 60/746; 60/806

(58) Field of Classification Search ..... 60/737, 60/740, 742, 746, 747, 748, 806; 239/399
See application file for complete search history.

(56) References Cited

U.S. PATENT DOCUMENTS 5,101,633 A 4/1992 Keller et al.
5,400,968 A * 3/1995 Sood ..... 239/132.5
5,613,363 A * 3/1997 Joshi et al. ..... 60/737
6,438,961 B2 * 8/2002 Tuthill et al. ..... 60/776
6,675,581 B1 * 1/2004 Stuttaford et al. ..... 60/737
6,993,916 B2 2/2006 Johnson et al.
7,007,477 B2 3/2006 Widener
7,165,405 B2 * 1/2007 Stuttaford et al. ..... 60/737
7,412,833 B2 8/2008 Widener
8,161,750 B2 * 4/2012 Simmons et al. ..... 60/737
2008/0078160 A1 4/2008 Kraemer et al.
2008/0264033 A1 10/2008 Lacy et al.
2008/0267783 A1 10/2008 Kraemer et al.
2008/0289341 A1 * 11/2008 Ishizaka et al. ..... 60/748
2010/0077760 A1 * 4/2010 Laster et al. ..... 60/742
2010/0101229 A1 * 4/2010 York et al. ..... 60/737
2011/0000214 A1 * 1/2011 Helmick et al. ..... 60/734
2011/0265485 A1 * 11/2011 Stoia et al. ..... 60/772
2012/0011854 A1 * 1/2012 Khan et al. ..... 60/772

OTHER PUBLICATIONS

Combustion Science and Technology; Burner Development and Operability Issues Associated with Steady Flowing Syngas Fired Combustors; Tim Lieuwen et al.; Jun. 1, 2008; pp. 1169-1192.
U.S. Appl. No. 12/256,901, filed Oct. 23, 2008, York, William David.

* cited by examiner

*Primary Examiner* — Ehud Gartenberg
*Assistant Examiner* — Lorne Meade
(74) *Attorney, Agent, or Firm* — Fletcher Yoder, P.C.

(57) ABSTRACT

A system that includes a turbine fuel nozzle comprising an air-fuel premixer. The air-fuel premixed includes a swirl vane configured to swirl fuel and air in a downstream direction, wherein the swirl vane comprises an internal coolant path from a downstream end portion in an upstream direction through a substantial length of the swirl vane.

32 Claims, 9 Drawing Sheets

GAS TURBINE PREMIXER WITH INTERNAL COOLING

STATEMENT REGARDING FEDERALLY SPONSORED RESEARCH & DEVELOPMENT

This invention was made with Government support under contract number DE-FC26-05NT42643 awarded by the Department of Energy. The Government has certain rights in the invention.

BACKGROUND OF THE INVENTION

The subject matter disclosed herein relates to a gas turbine premixer configured to premix fuel and air for combustion in a combustor of a gas turbine engine. More particularly, the subject matter disclosed herein relates to a cooling system for the gas turbine premixer.

A gas turbine engine combusts a mixture of fuel and air to generate hot combustion gases, which in turn drive one or more turbines. In particular, the hot combustion gases force turbine blades to rotate, thereby driving a shaft to rotate one or more loads, e.g., electrical generator. As appreciated, a flame develops in a combustion zone having a combustible mixture of fuel and air. Unfortunately, the flame can sometimes become located on or near surfaces not designed to be in close proximity to the reaction, which can result in damage due to the heat of combustion. This phenomenon in a fuel/air premixer is generally referred to as flame holding. For example, the flame holding may occur on or near a fuel-air premixer, which can rapidly fail due to the heat of combustion. Likewise, the flame can sometimes propagate upstream from the combustion zone, and cause damage to various components due to the heat of combustion. This phenomenon is generally referred to as flashback.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a fuel nozzle, comprising a central body, an outer tube disposed about the central body, an air path disposed between the central body and the outer tube, a vane disposed in the air path, wherein the vane comprises a fuel inlet, a fuel outlet, and a divider disposed between the fuel inlet and the fuel outlet, and a fuel path extending through the central body to the fuel inlet into the vane, wherein the fuel path extends through the vane in a non-straight direction about the divider from the fuel inlet to the fuel outlet.

In a second embodiment, an gas turbine fuel nozzle including a central body comprising a multi-directional flow passage having a first flow passage configured to channel fuel in a first axial direction, and a second flow passage configured to channel fuel in a second axial direction opposite from the first axial direction, an outer tube disposed about the central body, an air path disposed between the central body and the outer tube, a vane disposed in the air path, wherein the vane comprises a fuel inlet disposed in a downstream cavity of the vane relative to the first axial direction, a fuel outlet disposed in an upstream cavity of the vane relative to the first axial direction, a fuel path from the downstream cavity to the upstream cavity, and a bypass configured to channel fuel to the upstream cavity independent from the fuel path.

In a third embodiment, a system includes a turbine fuel nozzle comprising an air-fuel premixer having a swirl vane configured to swirl fuel and air in a downstream direction, wherein the swirl vane comprises an internal coolant path from a downstream end portion in an upstream direction through a substantial length of the swirl vane.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
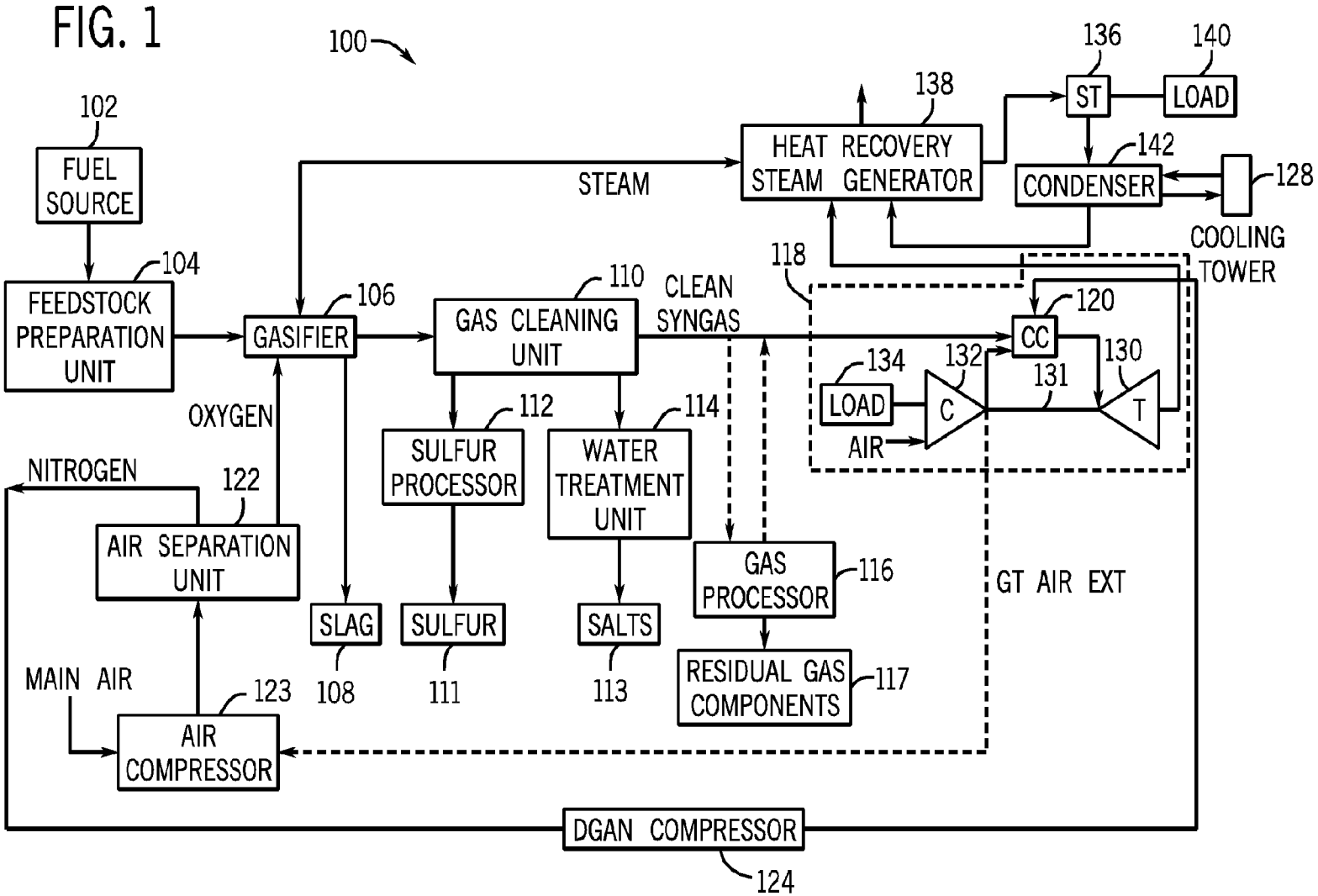
FIG. 1 a schematic block diagram of an embodiment of an integrated gasification combined cycle (IGCC) power plant.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

In certain embodiments, as discussed in detail below, a gas turbine engine includes one or more fuel nozzles with internal cooling passages to resist thermal damage associated with flashback and/or flame holding. In particular, the fuel nozzle may include one or more internal cooling passages in a fuel-air premixer, e.g., a swirl vane configured to facilitate fuel-air mixing prior to entry of the fuel and air into a combustion zone. For example, the fuel nozzle may include a plurality of swirl vanes in a circumferential arrangement, wherein the internal cooling passages extend along substantially an entire axial length of the swirl vanes. In certain embodiments, each internal cooling passage may route a coolant from a downstream end portion to an upstream end portion of the respective swirl vane, thereby providing maximum cooling at the downstream end portion. For example, the coolant may be the fuel, which may flow through the swirl vanes from the downstream end portion to the upstream end portion. At the upstream end portion, the fuel may exit from the swirl vane through one or more fuel ports, which direct the fuel into an air flow to create a fuel-air mixture. Thus, the fuel flow serves two functions, acting both as a fuel source for combustion and also acting as a heat exchanger medium to transfer heat away from the swirl vane prior to its injection into the air stream In certain embodiments, each internal cooling passage may receive a first portion of the fuel flow at the downstream end portion, while also receiving a second portion of the fuel flow at the upstream end portion. In other words, the second portion of the fuel flow may be described as a bypass flow, which does not flow along the entire axial length of the swirl vane from the downstream end portion to the upstream end portion. Thus, the system may control the first and second portions of the fuel flow to provide adjustments to the fuel system pressure drop, convective heat transfer coefficients, and fuel distribution to the fuel ports.

In the event of flame holding or flashback, the internal cooling passages provide thermal resistance, insulation, or protection against thermal damage for an amount of time sufficient to detect and correct the situation. For example, the internal cooling passages may provide thermal protection for at least greater than approximately 15, 30, 45, 60, 75, 90, or more seconds. Furthermore, the internal cooling passages, using fuel as the coolant or heat exchanger medium, provide a built-in failsafe in the event of thermal damage. In particular, the thermal damage may occur at the downstream end portion (e.g., tip) of the swirl vane, thereby causing the fuel to flow directly from the internal cooling passage into the air flow. As a result, the fuel flow is substantially or entirely detoured away from the fuel ports at the upstream end portion of the swirl vane, thereby substantially or entirely eliminating any fuel-air mixture upstream from the thermal damage at the downstream end portion (e.g., tip) of the swirl vane. Thus, the thermal damage at the downstream end portion (e.g., open tip) of the swirl vane may reduce or eliminate the possibility of any further damage to the fuel nozzle (e.g., further upstream).

FIG. 1 is a diagram of an embodiment of an integrated gasification combined cycle (IGCC) system 100 that may produce and burn a synthetic gas, i.e., syngas. Elements of the IGCC system 100 may include a fuel source 102, such as a solid feed, that may be utilized as a source of energy for the IGCC. The fuel source 102 may include coal, petroleum coke, biomass, wood-based materials, agricultural wastes, tars, coke oven gas and asphalt, or other carbon containing items.

The solid fuel of the fuel source 102 may be passed to a feedstock preparation unit 104. The feedstock preparation unit 104 may, for example, resize or reshaped the fuel source 102 by chopping, milling, shredding, pulverizing, briquetting, or palletizing the fuel source 102 to generate feedstock. Additionally, water, or other suitable liquids may be added to the fuel source 102 in the feedstock preparation unit 104 to create slurry feedstock. In other embodiments, no liquid is added to the fuel source, thus yielding dry feedstock.

The feedstock may be passed to a gasifier 106 from the feedstock preparation unit 104. The gasifier 106 may convert the feedstock into a syngas, e.g., a combination of carbon monoxide and hydrogen. This conversion may be accomplished by subjecting the feedstock to a controlled amount of steam and oxygen at elevated pressures, e.g., from approximately 20 bar to 85 bar, and temperatures, e.g., approximately 700 degrees Celsius to 1600 degrees Celsius, depending on the type of gasifier 106 utilized. The gasification process may include the feedstock undergoing a pyrolysis process, whereby the feedstock is heated. Temperatures inside the gasifier 106 may range from approximately 150 degrees Celsius to 700 degrees Celsius during the pyrolysis process, depending on the fuel source 102 utilized to generate the feedstock. The heating of the feedstock during the pyrolysis process may generate a solid, (e.g., char), and residue gases, (e.g., carbon monoxide, hydrogen, and nitrogen). The char remaining from the feedstock from the pyrolysis process may only weigh up to approximately 30% of the weight of the original feedstock.

A combustion process may then occur in the gasifier 106. The combustion may include introducing oxygen to the char and residue gases. The char and residue gases may react with the oxygen to form carbon dioxide and carbon monoxide, which provides heat for the subsequent gasification reactions. The temperatures during the combustion process may range from approximately 700 degrees Celsius to 1600 degrees Celsius. Next, steam may be introduced into the gasifier 106 during a gasification step. The char may react with the carbon dioxide and steam to produce carbon monoxide and hydrogen at temperatures ranging from approximately 800 degrees Celsius to 1100 degrees Celsius. In essence, the gasifier utilizes steam and oxygen to allow some of the feedstock to be "burned" to produce carbon monoxide and release energy, which drives a second reaction that converts further feedstock to hydrogen and additional carbon dioxide.

In this way, a resultant gas is manufactured by the gasifier 106. This resultant gas may include approximately 85% of carbon monoxide and hydrogen in equal proportions, as well as $CH_4$, HCl, HF, COS, $NH_3$, HCN, and $H_2S$ (based on the sulfur content of the feedstock). This resultant gas may be termed dirty syngas, since it contains, for example, $H_2S$. The gasifier 106 may also generate waste, such as slag 108, which may be a wet ash material. This slag 108 may be removed from the gasifier 106 and disposed of, for example, as road base or as another building material. To clean the dirty syngas, a gas cleaning unit 110 may be utilized. The gas cleaning unit 110 may scrub the dirty syngas to remove the HCl, HF, COS, HCN, and $H_2S$ from the dirty syngas, which may include separation of sulfur 111 in a sulfur processor 112 by, for example, an acid gas removal process in the sulfur processor 112. Furthermore, the gas cleaning unit 110 may separate salts 113 from the dirty syngas via a water treatment unit 114 that may utilize water purification techniques to generate usable salts 113 from the dirty syngas. Subsequently, the gas from the gas cleaning unit 110 may include clean syngas, (e.g., the sulfur 111 has been removed from the syngas), with trace amounts of other chemicals, e.g., $NH_3$ (ammonia) and $CH_4$ (methane).

A gas processor 116 may be utilized to remove residual gas components 117 from the clean syngas such as, ammonia and methane, as well as methanol or any residual chemicals. However, removal of residual gas components 117 from the clean syngas is optional, since the clean syngas may be utilized as a fuel even when containing the residual gas components 117, e.g., tail gas. At this point, the clean syngas may include approximately 3% CO, approximately 55% $H_2$, and approximately 40% $CO_2$ and is substantially stripped of $H_2S$. This clean syngas may be transmitted to a combustor 120, e.g., a combustion chamber, of a gas turbine engine 118 as combustible fuel. Alternatively, the $CO_2$ may be removed from the clean syngas prior to transmission to the gas turbine engine.

The IGCC system 100 may further include an air separation unit (ASU) 122. The ASU 122 may operate to separate air into component gases by, for example, distillation techniques. The ASU 122 may separate oxygen from the air supplied to it from a supplemental air compressor 123, and the ASU 122 may transfer the separated oxygen to the gasifier 106. Additionally the ASU 122 may transmit separated nitrogen to a diluent nitrogen (DGAN) compressor 124.

The DGAN compressor 124 may compress the nitrogen received from the ASU 122 at least to pressure levels equal to those in the combustor 120, so as not to interfere with the proper combustion of the syngas. Thus, once the DGAN compressor 124 has adequately compressed the nitrogen to a proper level, the DGAN compressor 124 may transmit the compressed nitrogen to the combustor 120 of the gas turbine engine 118. The nitrogen may be used as a diluent to facilitate control of emissions, for example.

As described previously, the compressed nitrogen may be transmitted from the DGAN compressor 124 to the combustor 120 of the gas turbine engine 118. The gas turbine engine 118 may include a turbine 130, a drive shaft 131 and a compressor 132, as well as the combustor 120. The combustor 120 may receive fuel, such as syngas, which may be injected under pressure from fuel nozzles. This fuel may be mixed with compressed air as well as compressed nitrogen from the DGAN compressor 124, and combusted within combustor 120. This combustion may create hot pressurized exhaust gases.

The combustor 120 may direct the exhaust gases towards an exhaust outlet of the turbine 130. As the exhaust gases from the combustor 120 pass through the turbine 130, the exhaust gases force turbine blades in the turbine 130 to rotate the drive shaft 131 along an axis of the gas turbine engine 118. As illustrated, the drive shaft 131 is connected to various components of the gas turbine engine 118, including the compressor 132.

The drive shaft 131 may connect the turbine 130 to the compressor 132 to form a rotor. The compressor 132 may include blades coupled to the drive shaft 131. Thus, rotation of turbine blades in the turbine 130 may cause the drive shaft 131 connecting the turbine 130 to the compressor 132 to rotate blades within the compressor 132. This rotation of blades in the compressor 132 causes the compressor 132 to compress air received via an air intake in the compressor 132. The compressed air may then be fed to the combustor 120 and mixed with fuel and compressed nitrogen to allow for higher efficiency combustion. Drive shaft 131 may also be connected to load 134, which may be a stationary load, such as an electrical generator for producing electrical power, for example, in a power plant. Indeed, load 134 may be any suitable device that is powered by the rotational output of the gas turbine engine 118.

The IGCC system 100 also may include a steam turbine engine 136 and a heat recovery steam generation (HRSG) system 138. The steam turbine engine 136 may drive a second load 140. The second load 140 may also be an electrical generator for generating electrical power. However, both the first and second loads 134, 140 may be other types of loads capable of being driven by the gas turbine engine 118 and steam turbine engine 136. In addition, although the gas turbine engine 118 and steam turbine engine 136 may drive separate loads 134 and 140, as shown in the illustrated embodiment, the gas turbine engine 118 and steam turbine engine 136 may also be utilized in tandem to drive a single load via a single shaft. The specific configuration of the steam turbine engine 136, as well as the gas turbine engine 118, may be implementation-specific and may include any combination of sections.

The system 100 may also include the HRSG 138. Heated exhaust gas from the gas turbine engine 118 may be transported into the HRSG 138 and used to heat water and produce steam used to power the steam turbine engine 136. Exhaust from, for example, a low-pressure section of the steam turbine engine 136 may be directed into a condenser 142. The condenser 142 may utilize a cooling tower 128 to exchange heated water for chilled water. The cooling tower 128 acts to provide cool water to the condenser 142 to aid in condensing the steam transmitted to the condenser 142 from the steam turbine engine 136. Condensate from the condenser 142 may, in turn, be directed into the HRSG 138. Again, exhaust from the gas turbine engine 118 may also be directed into the HRSG 138 to heat the water from the condenser 142 and produce steam.

In combined cycle systems such as IGCC system 100, hot exhaust may flow from the gas turbine engine 118 and pass to the HRSG 138, where it may be used to generate high-pressure, high-temperature steam. The steam produced by the HRSG 138 may then be passed through the steam turbine engine 136 for power generation. In addition, the produced steam may also be supplied to any other processes where steam may be used, such as to the gasifier 106. The gas turbine engine 118 generation cycle is often referred to as the "topping cycle," whereas the steam turbine engine 136 generation cycle is often referred to as the "bottoming cycle." By combining these two cycles as illustrated in FIG. 1, the IGCC system 100 may lead to greater efficiencies in both cycles. In particular, exhaust heat from the topping cycle may be captured and used to generate steam for use in the bottoming cycle.

Figure 2:
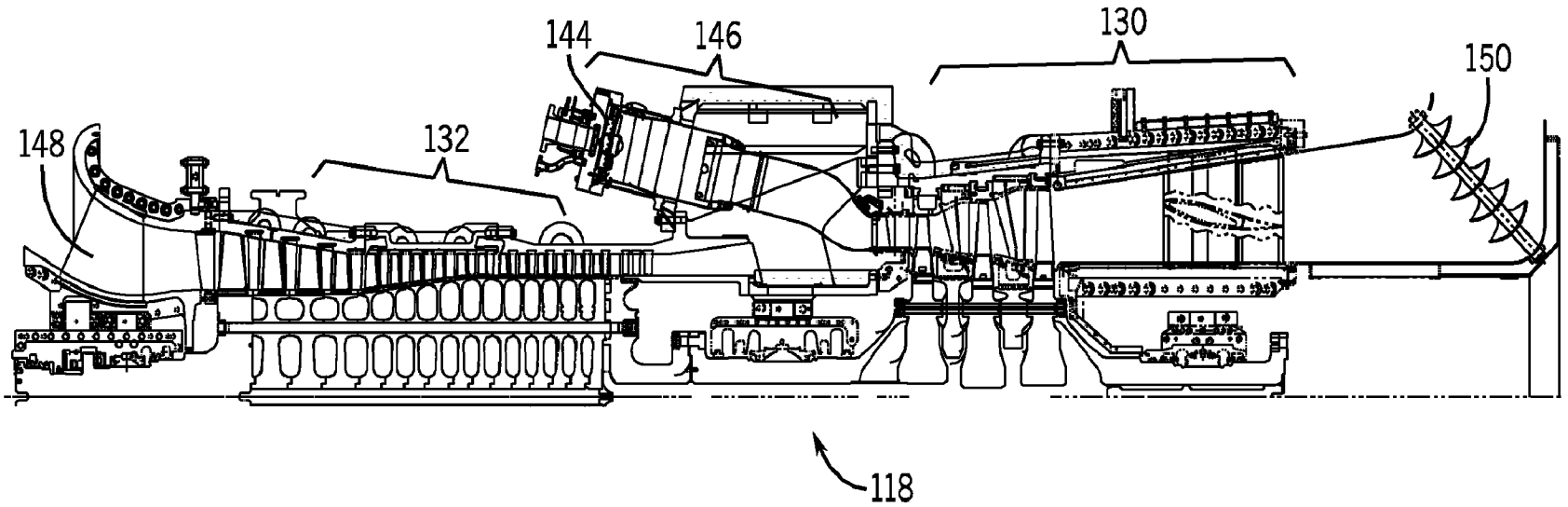
FIG. 2 is a cutaway side view of a gas turbine engine, as shown in FIG. 1, in accordance with an embodiment of the present technique.

FIG. 2 is a cutaway side view of an embodiment of the gas turbine engine 118. The gas turbine engine 118 may use liquid and/or gas fuel, such as natural gas and/or a hydrogen rich syngas, to operate. The gas turbine engine 118 includes one or more fuel nozzles 144 located inside one or more combustors 146. As depicted, fuel nozzles 144 intake a fuel supply, mix the fuel with compressed air, discussed below, and distribute the air-fuel mixture into a combustor 146, where the mixture combusts, thereby creating hot pressurized exhaust gases. In one embodiment, six or more fuel nozzles 144 may be attached to the head end of each combustor 146 in an annular or other arrangement. Moreover, the gas turbine engine 118 may include a plurality of combustors 146 (e.g., 4, 6, 8, or 12) in an annular arrangement.

Air enters the gas turbine engine 118 through air intake 148 and may be pressurized in one or more compressor stages of compressor 132. The compressed air may then be mixed with gas for combustion within combustor 146. For example, fuel nozzles 144 may inject a fuel-air mixture into combustors in a suitable ratio for optimal combustion, emissions, fuel consumption, and power output. As discussed below, certain embodiments of the fuel nozzles 144 include internal cooling passages configured to provide thermal resistance to thermal damage associated with flashback and/or flame holding. The combustor 146 directs the exhaust gases through one or more turbine stages of turbine 130 toward an exhaust outlet 150, to generate power, as described above with respect to FIG. 1.

Figure 3:
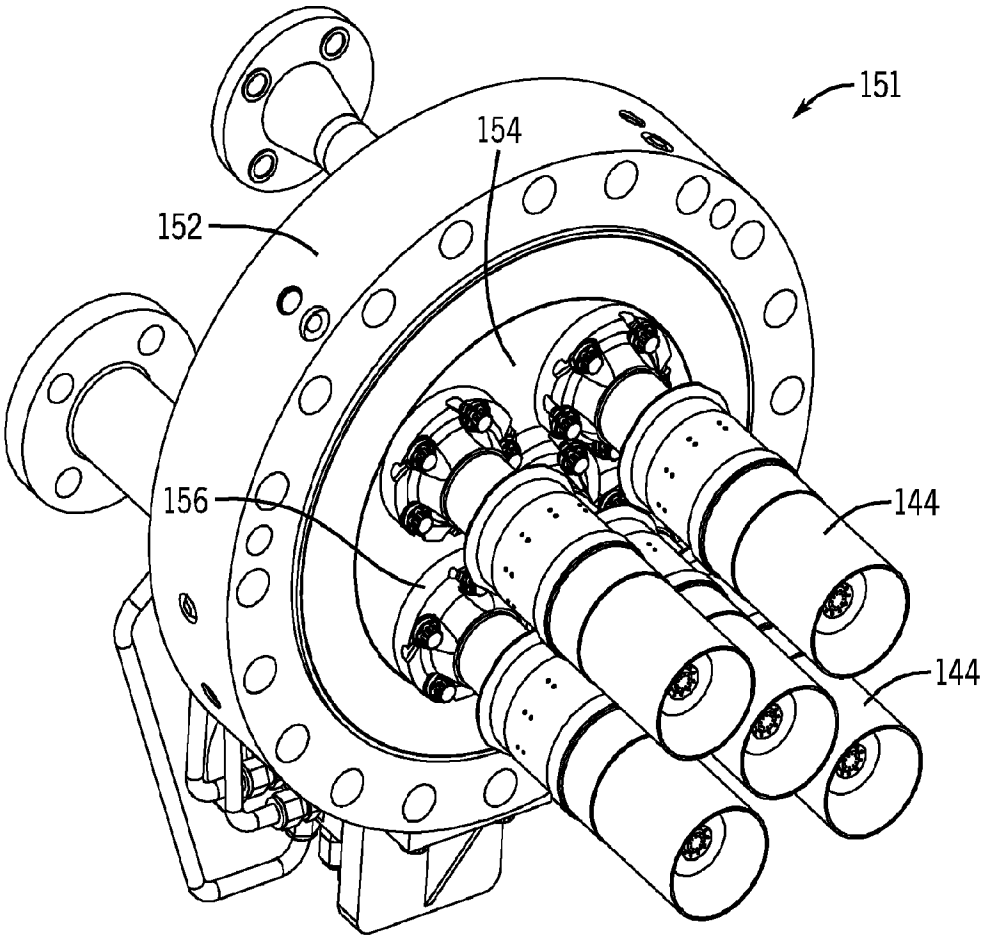
FIG. 3 is a perspective view of a head end of a combustor of the gas turbine engine, as shown in FIG. 2, illustrating multiple fuel nozzles in accordance with certain embodiments of the present technique.

FIG. 3 is a detailed perspective view of an embodiment of a combustor head end 151 having an end cover 152 with a plurality of fuel nozzles 144 attached at a surface 154 via sealing joints 156. In the illustration, five fuel nozzles 144 are attached to end cover base surface 154 via joints 156. However, any suitable number and arrangement of fuel nozzles 144 may be attached to end cover base surface 154 via the joints 156. The head end 151 routes the compressed air from the compressor 132 and the fuel through end cover 152 to each of the fuel nozzles 144, which substantially premix the compressed air and fuel as an air fuel mixture prior to entry into a combustion zone in the combustor 146. As discussed in further detail below, the fuel nozzles 144 may include one or more internal cooling passages configured to provide thermal resistance to thermal damage associated with flashback and/or flame holding.

Figure 4:
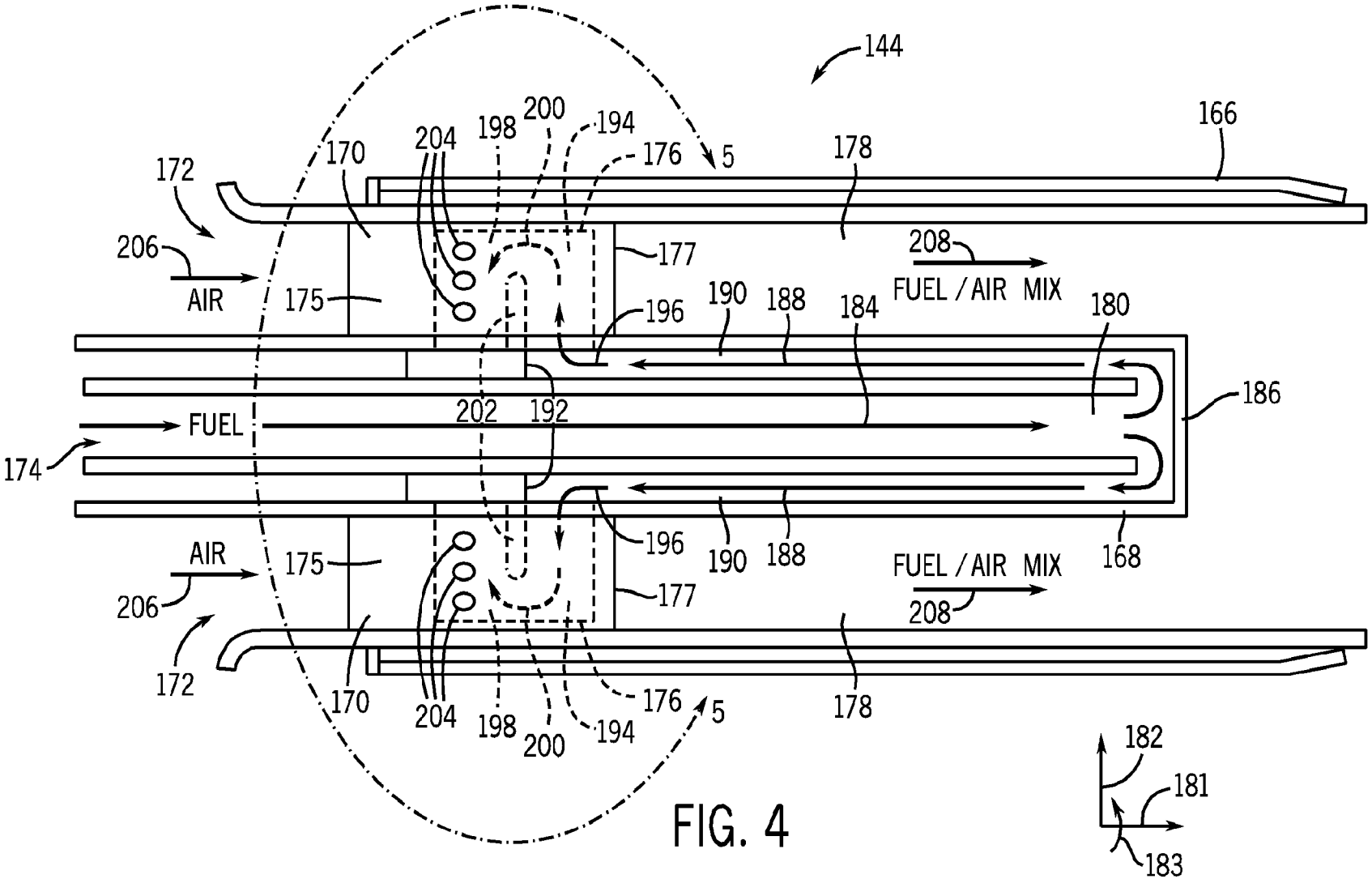
FIG. 4 is a cross-sectional side view of a fuel nozzle, as shown in FIG. 3, illustrating a premixer with internal cooling in accordance with certain embodiments of the present technique.

FIG. 4 is a cross-sectional side view of an embodiment of a fuel nozzle 144 having an internal cooling system configured to provide thermal resistance to thermal damage associated with flashback and/or flame holding. In the illustrated embodiment, the fuel nozzle 144 includes an outer peripheral wall 166 and a nozzle center body 168 disposed within the outer wall 166. The outer peripheral wall 166 may be described as a burner tube, whereas the nozzle center body 168 may be described as a fuel supply tube. The fuel nozzle 144 also includes a fuel/air pre-mixer 170, an air inlet 172, a fuel inlet 174, swirl vanes 176, a mixing passage 178 (e.g., annular passage for mixing fuel and air), and a fuel passage 180. The swirl vanes 176 are configured to induce a swirling flow within the fuel nozzle 144. Thus, the fuel nozzle 144 may be described as a swozzle in view of this swirl feature. It should be noted that various aspects of the fuel nozzle 144 may be described with reference to an axial direction or axis 181, a radial direction or axis 182, and a circumferential direction or axis 183. For example, the axis 181 corresponds to a longitudinal centerline or lengthwise direction, the axis 182 corresponds to a crosswise or radial direction relative to the longitudinal centerline, and the axis 183 corresponds to the circumferential direction about the longitudinal centerline.

As shown, fuel enters the nozzle center body 168 through fuel inlet 174 into fuel passage 180. Fuel travels axially 181 in a downstream direction, as noted by direction arrow 184, through the entire length of center body 168 until it impinges upon an interior end wall 186 (e.g., a downstream end portion) of the fuel passage 180, whereupon the fuel reverses flow, as indicated by directional arrow 188, and enters a reverse flow passage 190 in an upstream axial direction. Reverse flow passage 190 is located concentric to fuel passage 180. Thus, the fuel first flows downstream toward the combustion zone along the axis 181 in the axial direction 184, radially traverses the interior end wall 186 in a radial direction relative to axis 182, and then flows upstream away from the combustion zone along the axis 181 in the axial direction 188. For purposes of discussion, the term downstream may represent a direction of flow of the combustion gases through the combustor 120 toward the turbine 130, whereas the term upstream may represent a direction away from or opposite to the direction of flow of the combustion gases through the combustor 120 toward the turbine 130.

At the axially 181 extending end of reverse flow passage 190 opposite end wall 186, fuel impinges upon wall 192 (e.g., upstream end portion) and is directed into a cooling chamber 194 (e.g., a downstream cavity or passage), as may be seen by arrow 196. Thereupon, fuel travels from the cooling chamber 194 to an outlet chamber 198 (e.g., an upstream cavity or passage), as indicated by arrow 200. The flow of fuel, as seen by arrow 200, is not direct from the cooling chamber 194 to the outlet chamber 198. Indeed, the flow is at least partially blocked or redirected by a divider 202. The divider 202 may, for example, be a piece of metal that restricts the direction of flow of the fuel into the outlet chamber 198, thus causing the fuel to internally cool all surfaces of the vane 176. In certain embodiments, the chambers 194 and 198 and the divider 202 may be described as a non-linear coolant flow passage, e.g., a zigzagging coolant flow passage, a U-shaped coolant flow passage, a serpentine coolant flow passage, or a winding coolant flow passage.

The fuel may pass around the divider 202 and into the output chamber 198, whereby the fuel may be expelled from the outlet chamber 198 through fuel injection ports 204 in the swirl vanes 176, whereat the fuel may mix with air flowing through mixing passage 178 from air inlet 172, as illustrated by arrow 206. For example, the fuel injection ports 204 may inject the fuel crosswise to the air flow to induce mixing. Likewise, the swirl vanes 176 induce a swirling flow of the air and fuel, thereby increasing the mixture of the air and fuel. The fuel/air mixture exits premixer 170 and continues to mix as it flows through the mixing passage 178, as indicated by directional arrow 208. This continuing mixing of the fuel and air through the premixing passage 178 allows the fuel/air mixture exiting the premixing passage 178 to be substantially fully mixed when it enters the combustor 146, where the mixed fuel and air may be combusted. The configuration of the fuel nozzle 144 also allows for the use of fuel as a heat exchanger medium or heat transfer fluid before it is mixed with the air. That is, the fuel may operate as a cooling fluid for the mixing passage 178 when, for example, flashback, (e.g., flame propagation from the combustor reaction zone into the premixing passage 178) occurs and a flame resides in the premixer 170 and/or the mixing passage 178. This fuel nozzle 144 is very effective for mixing the air and fuel, for achieving low emissions and also for providing stabilization of the flame downstream of the fuel nozzle exit, in the combustor reaction zone.

Figure 5:
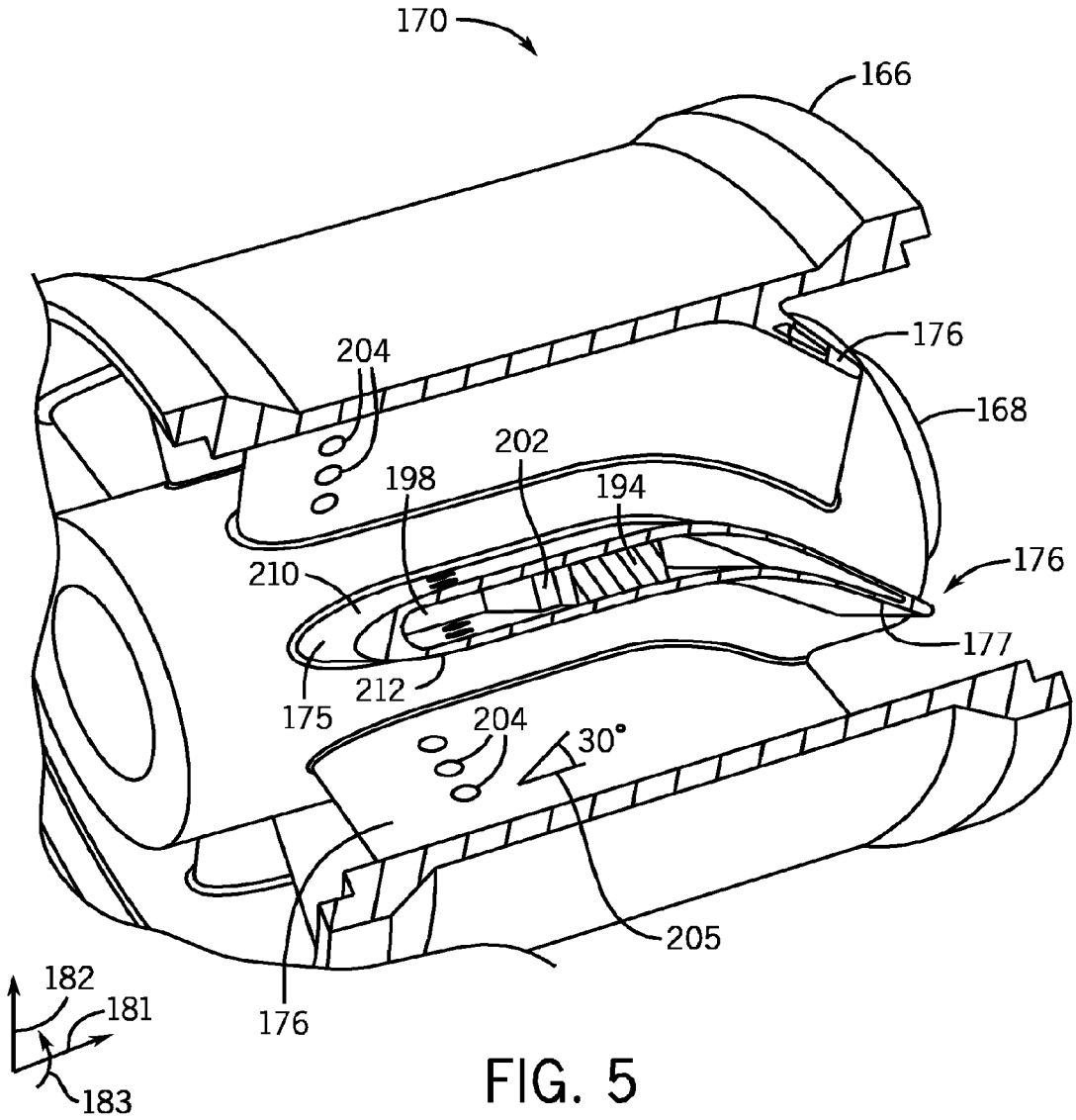
FIG. 5 is a perspective cutaway view of the fuel nozzle, as shown in FIG. 4, illustrating internal cooling in a swirl vane of the premixer in accordance with certain embodiments of the present technique.

FIG. 5 is a perspective cutaway view of an embodiment of the premixer 170 taken within arcuate line 5-5 of FIG. 4. The premixer 170 includes the swirl vanes 176 disposed circumferentially around the nozzle center body 168, wherein the vanes 176 extend radially outward from the nozzle center body 168 to the outer wall 166. As illustrated, each swirl vane 176 is a hollow body, e.g., a hollow airfoil shaped body, having the cooling chamber 194, the outlet chamber 198, and the divider 202. The fuel enters the cooling chamber 194 near a downstream end portion of the swirl vane 176, travels upstream in a non-linear path about the divider 202 to the outlet chamber 198, and then exits the outlet chamber 198 through the fuel injection ports 204. Thus, the fuel flow through each swirl vane 176 acts as a coolant prior to entry into the air flow. Again, the fuel flow cools the swirl vane 176 along substantially the entire length of the swirl vane 176, and provides maximum cooling at the downstream end portion 177. For example, the fuel flow may cool at least 50, 60, 70, 80, 90, or 100 percent of the length of each swirl vane 176 along the axis 181.

In the event of flashback or flame holding in the fuel nozzle 144, the internal cooling through each swirl vane 176 (e.g., via chambers 194 and 198) may provide thermal protection for a time duration sufficient to take corrective measures to eliminate the flashback or flame holding. For example, the internal cooling through each swirl vane 176 may provide thermal protection for at least greater than approximately 15, 30, 45, 60, 75, 90, or more seconds. Furthermore, the internal cooling through each swirl vane 176, using fuel as the coolant or heat exchanger medium, provides a built-in failsafe in the event of thermal damage. In particular, the thermal damage may occur at the downstream end portion 177 (e.g., downstream tip) of the swirl vane 176, thereby causing the fuel to flow directly from the cooling chamber 194 into the air flow. As a result, the fuel flow is substantially or entirely detoured away the fuel ports 204 at the upstream end portion 175 of the swirl vane 176, thereby substantially or entirely eliminating any fuel-air mixture upstream from the thermal damage at the downstream end portion 177 (e.g., downstream tip) of the swirl vane 176. Thus, the thermal damage at the downstream end portion 177 (e.g., open downstream tip) of the swirl vane 176 may reduce or eliminate the possibility of any further damage to the fuel nozzle 144 (e.g., further upstream), though this may result in an increase in emissions of nitrogen oxides In the illustrated embodiment, the premixer 170 includes eight swirl vanes 176 equally spaced at 45 degree increments about the circumference of the nozzle center body 168. In certain embodiments, the premixer 170 may include any number of swirl vanes 176 (e.g., 4, 5, 6, 7, 8, 9, 10, 11, 12, 13 or 14) disposed at equal or different increments about the circumference of the nozzle center body 168. The swirl vanes 176 are configured to swirl the air flow, and thus induce fuel-air mixing, in a circumferential direction 183 about the axis 181. As illustrated, each swirl vanes 176 bends or curves from the upstream end portion 175 to the downstream end portion 177. In particular the upstream end portion 175 is generally oriented in an axial direction along the axis 181, whereas the downstream end portion 177 is generally angled, curved, or directed away from the axial direction along the axis 181. For example, the downstream end portion 177 may be angled relative to the upstream end portion 177 by an angle of approximately 5 to 60 degrees, or approximately 10 to 45 degrees. As a result, the downstream end portion 177 of each swirl vane 176 biases or guides the flow into a rotational path about the axis 181 (e.g., swirling flow). This swirling flow enhances fuel-air mixing within the fuel nozzle 144 prior to delivery into the combustor 120.

Additionally, one or more injection ports 204 may be disposed on the vanes 176 at the upstream end portion 175. For example, these injection ports 204 may be approximately 1 to 100, 10 to 50, 20 to 40, or 24 to 35 thousandths of an inch in diameter. In one embodiment, the injection ports 204 may be approximately 30 to 50 thousandths of an inch in diameter. Each swirl vane 176 may include 1, 2, 3, 4, 5, 6, 7, 8, 9, 10 or more fuel injection ports 204 on first and/or second sides 210 and 212 of the vane 176. The first and second sides 210 and 212 may combine to form the outer surface of the vane 176. For example, the first and second sides 210 and 212 may define an airfoil shaped surface as discussed above. In certain embodiments, each swirl vane 176 may include approximately 1 to 5 fuel injection ports 204 on the first side 210, and approximately 1 to 5 fuel injection ports 204 on the second side 212. However, some embodiments may exclude fuel injection ports 204 on the first side 210 or the second side 212.

Furthermore, each fuel injection port 204 may be oriented in an axial direction along the axis 181, a radial direction along the axis 182. In other words, each fuel injection port 204 may have a simple or compound angle 205 relative to a surface of the swirl vane 176, thereby influencing fuel-air mixing and varying the size of the recirculation zones behind the fuel jets. For example, the injection ports 204 may cause the fuel to flow into the premixer 170 at an angle of approximately 5 to 45, 10 to 60, or 20 to 90 degrees from the surface of first side 210 and/or the second side 212 of the swirl vane 176. By further example, the fuel injection ports 204 may cause the fuel to enter the premixer 170 at a compound angle of approximately 5, 10, 15, 20, 25, 30, 35, 40, 45, 50, 55, or 60 degrees with respect to the axial direction 181. Angling the injection ports 204 in this manner may allow for more complete mixing of the air-fuel mixture in the premixer 170.

This premixing, as well as the curved airfoil shape of the vane 176, may allow for a more uniform fuel air mixture. For example, the premixing may enable a clean burn with approximately 2-3 parts per million (ppm) of NOx (nitrogen oxides) emissions. Without nearly complete mixing of air and fuel, peak temperatures in the reaction zone may be higher than a uniform, lean mixture. This may lead to, for example, approximately 200 ppm of nitrogen oxides in the exhaust stream rather than approximately 2-3 ppm of nitrogen oxides in the exhaust when the fuel is substantially mixed.

Figure 6:
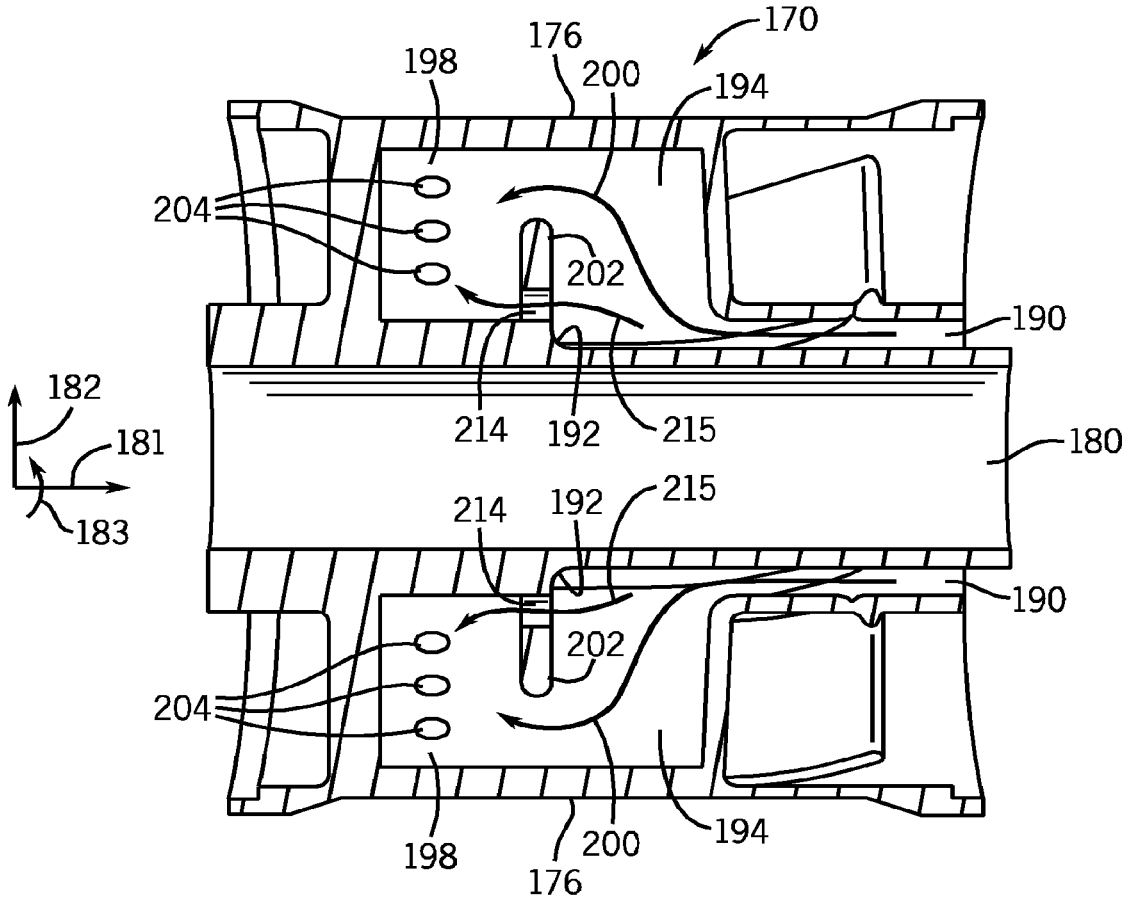
FIG. 6 is a cutaway side view of the premixer, as shown in FIG. 5, illustrating internal cooling in a swirl vane in accordance with certain embodiments of the present technique.

FIG. 6 is a cutaway side view of an embodiment of the premixer 170 taken within arcuate line 5-5 of FIG. 4. As illustrated in FIG. 6, the premixer 170 may receive fuel from the reverse flow passage 190 as seen by arrow 200. That is, the fuel may flow from the reverse flow passage 190 into the cooling chamber 194 around the divider 202 and into the outlet chamber 198. Additionally, a bypass hole 214 (e.g., a crossover passage) may be positioned between the cooling chamber 194 and the outlet chamber 198. This bypass hole 214 may extend radially 182 outwards relative to the wall 192 until it reaches the divider 202. That is, the bypass hole 214, in effect, removes a portion of the divider 202, axially through the divider 202, such that fuel may flow directly from the cooling chamber 194 axially into the outlet chamber 198, as indicated by directional arrow 215. This bypass hole 214 may allow, for example, approximately 1 to 50, 5 to 40, or 10 to 20 percent of the total fuel flowing from the cooling chamber 194 into the outlet chamber 198 to flow directly between the chambers 194 and 198. Utilization of the bypass hole 214 may allow for adjustments to any fuel system pressure drops that may occur, adjustments for conductive heat transfer coefficients, or adjustments to fuel distribution to the injection ports 204. That is, for example, more or less fuel may be directly transmitted to the injection ports 204 when a bypass hole 214 is utilized in the swirl vane 176. The bypass hole 214 may improve the distribution of fuel into and through the injection ports 204, e.g., more uniform distribution. The bypass hole 214 also may reduce the pressure drop from the chamber 194 to the chamber 198, thereby helping to force the fuel through the injection ports 204. Additionally, use of the bypass hole 214 may allow for tailored flow through the fuel injection ports 204 to change the amount of swirl that the fuel flow contains prior to injection into the premixer 170 via the injection ports 204.

Figure 7:
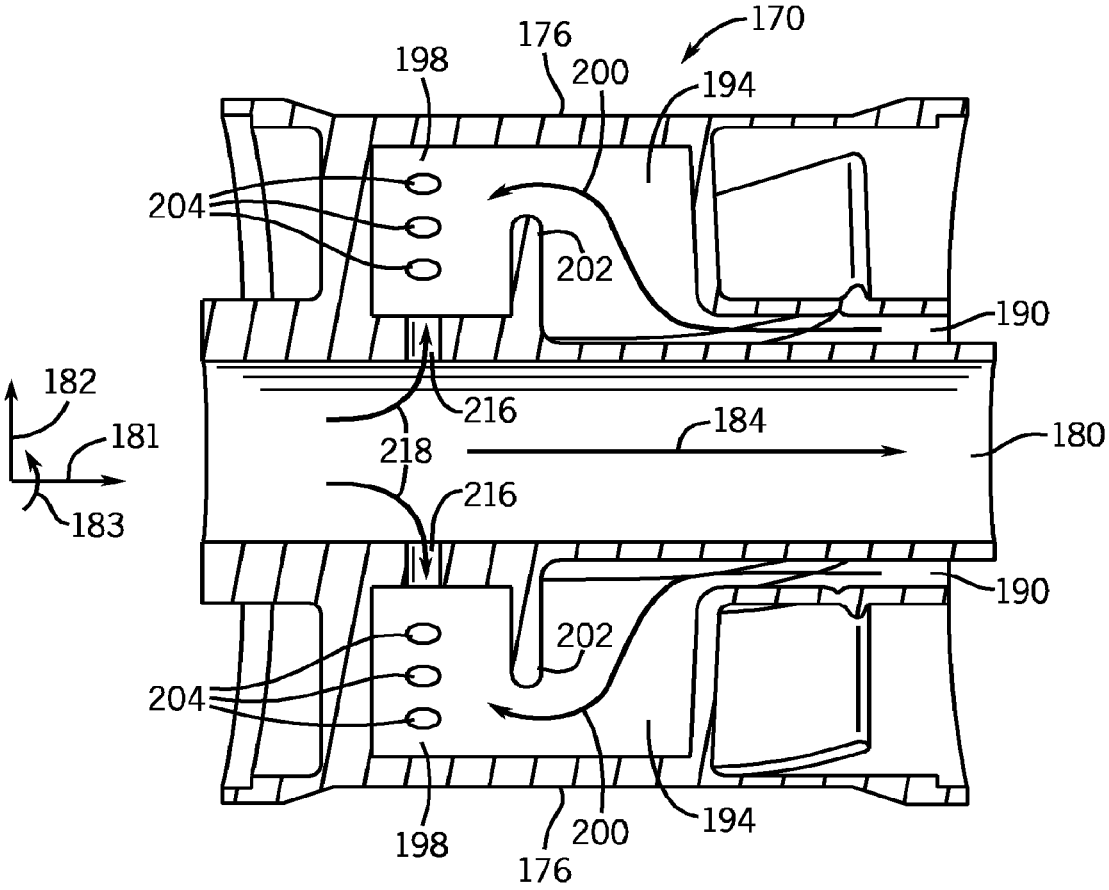
FIG. 7 is a cutaway side view of the premixer, as shown in FIG. 5, illustrating internal cooling in a swirl vane in accordance with certain embodiments of the present technique.
Figure 9:
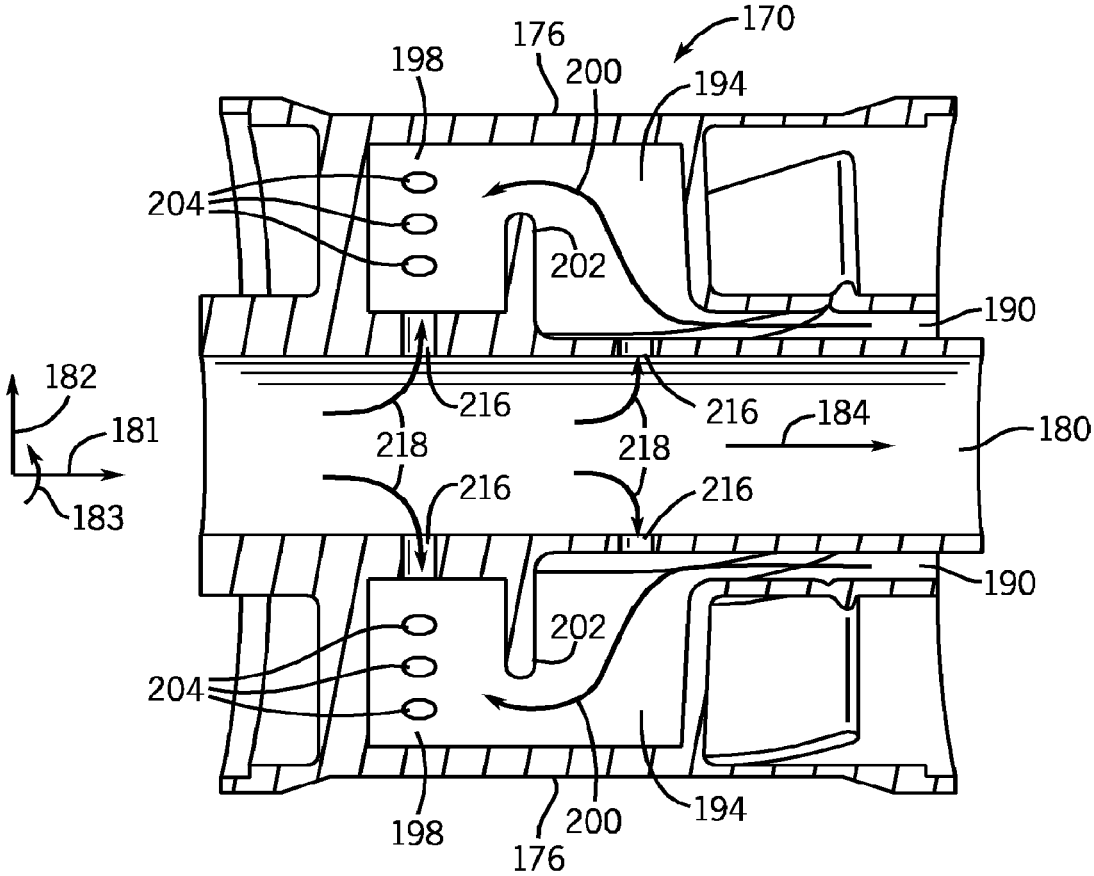

FIG. 7 is a cutaway side view of an embodiment of the premixer 170 taken within arcuate line 5-5 of FIG. 4. The premixer 170 may include all elements of the vane 176 as illustrated in FIG. 6, absent the bypass hole 214. Thus, the divider 202 does not include a bypass to allow for the direct transmission of fuel from the cooling chamber 194 into the outlet chamber 198. Instead, each swirl vane 176 may include a bypass hole 216 separate from the divider 202 (i.e., not between chambers 194 and 198) to allow fuel to flow directly into the outlet chamber 198 from the fuel passage 180 (i.e., not from the fuel passage 190), as indicated by directional arrow 218. Again, this bypass hole 216 may allow for approximately 1 to 50, 5 to 40, or 10 to 20 percent of the total fuel flowing through the injection ports 204 to flow into the outlet chamber 198. This may allow for, again, direct control over the amount, distribution, and direction of fuel flowing into the injection ports 204 and also control the amount of fuel traveling the lengths of passages 180 and 190. Likewise, the bypass hole 216 may substantially reduce the pressure drop from the chamber 194 to the chamber 198, thereby helping to force the fuel out through the injection ports 204. In a further embodiment as illustrated in FIG. 9, a bypass hole 216 may allow fuel to flow directly into the cooling chamber 194 from the fuel passage 180, instead of or in addition to the bypass hole 216 that allows fuel to flow directly into the outlet chamber 198 from the fuel passage 180.

Figure 8:
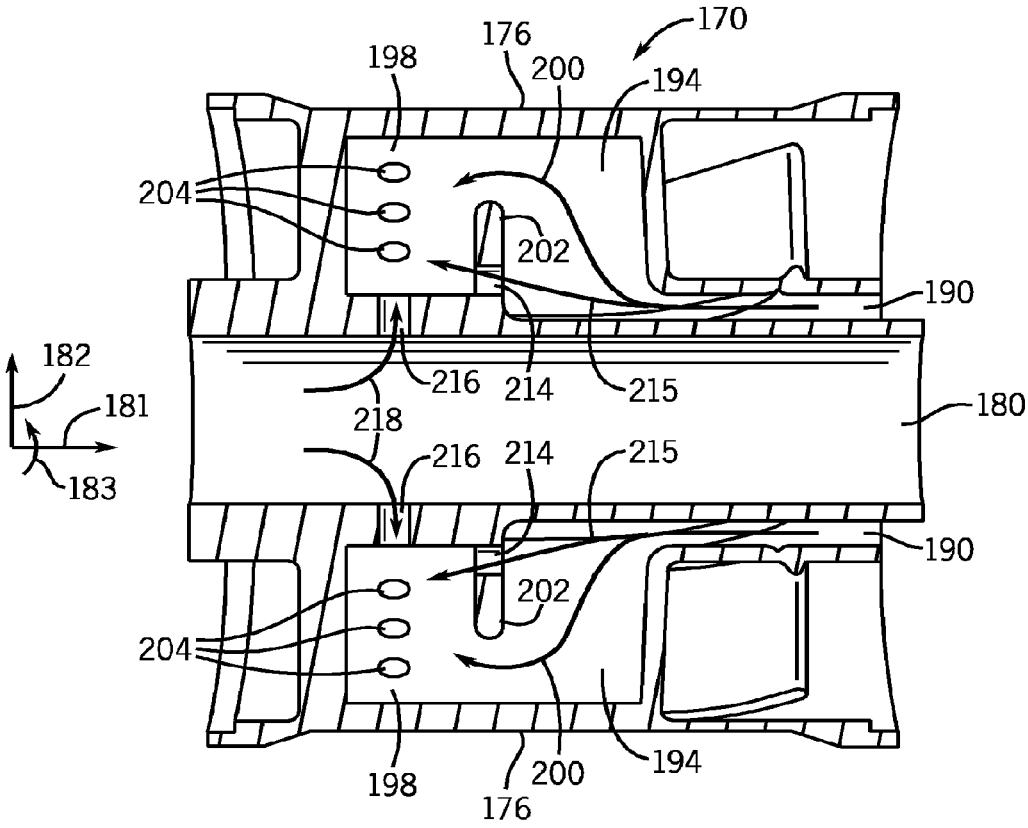
FIGS. 8 and 9 are cutaway side views of the premixer, as shown in FIG. 5, illustrating internal cooling in a swirl vane in accordance with certain embodiments of the present technique.

FIG. 8 is a cutaway side view of an embodiment of the premixer 170 taken within arcuate line 5-5 of FIG. 4, further illustrating a combination of the embodiments illustrated in FIGS. 6 and 7. As illustrated in FIG. 8, each swirl vane 176 may include both a bypass hole 214 from the passage 190 and a bypass hole 216 from the passage 180. In this manner, the bypass holes 214 and 216 may route between approximately 5 to 60, 10 to 50, or 20 to 40 percent of the total fuel to enter the injection ports 204 directly into outlet chamber 198 without first passing through the cooling chamber 194 and around the divider 202. In this manner, more fuel may be directly passed to the injection ports 204, which may allow for better control of the fuel injected into the premixer 170 and control of the fuel pressure loss. However, as a trade off, the reduced fuel flow along directional arrow 200 may not cool the vane 176 as thoroughly.

It should be noted that the fuel as it passes through the vane 176 may be approximately 50 to 500 degrees Fahrenheit. In contrast, syngas may burn at a temperature of approximately 3000 degrees Fahrenheit. Accordingly, the cooling of the materials utilized in manufacturing the premixer 170 via the fuel in the vane 176 may allow the premixer 170 to continue to function when exposed to burning syngas for a short period, for example, approximately 15, 30, 45, 60, 75, 90, or more seconds. The material utilized to manufacture the premixer 170 may be, for example, steel, or an alloy containing cobalt and/or chromium. One manufacturing technique that may be used to manufacture premixer 170 is a direct metal laser sintering process. Other manufacturing methods include casting and welding or brazing. By utilizing the fuel as the cooling medium for both the premixer channel 178, as well as the vanes 176, a held flame may be sustained for up to a minute in the passage 178, without damaging the fuel nozzle 144. That is, the flame that typically resides approximately 0.5-2 inches past the downstream end of the fuel nozzle 144 into the combustion chamber of the combustor 146 may, due to the high reactivity of the syngas (particularly the hydrogen in the syngas), flashback into the passage 178 to the premixer 170. This occurrence may be monitored, and by cooling the elements of the fuel nozzle 144, a user or an automated control system may have up to a minute to eliminate the held flame in the premixer by a method including, but not limited to, reducing fuel flow, increasing air flow, or modifying the composition of the fuel to the nozzle 144.

In this manner, no additional cooling fluid is required to be introduced into the fuel nozzle 144 to aid in reducing flashback damage in the fuel nozzle 144, because the fuel may act as a heat exchanger fluid for reducing the overall temperature to which the passage and the premixer 170 are exposed. Additionally, by including the divider 202 in the vanes 176, fuel may flow through the entire interior portion of the vanes 176, thus providing a coolant flow as a heat exchanger in cases of flashback into the premixer 170. In this manner, instead of a flashback destroying, for example, the vanes 176 in the premixer 170 due to exposure to the high heat (e.g., approximately 2000 degrees Fahrenheit), the overall temperature is reduced by the heat transfer occurring inside the premixer 170 via the fuel passing through the vanes 176 and the reverse flow passage 190. This may reduce the temperature that the premixer 170 is exposed to, thus allowing the premixer 170, as well as the vanes 176 therein, to resist damage via flashback or held flame in the premixer 170

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

A system that includes a turbine fuel nozzle comprising an air-fuel premixer. The air-fuel premixer includes a swirl vane configured to swirl fuel and air in a downstream direction, wherein the swirl vane comprises an internal coolant path from a downstream end portion in an upstream direction through a substantial length of the swirl vane.

The invention claimed is:

1. A system, comprising:

a fuel nozzle, comprising:

a central body;

an outer tube disposed about the central body;

an air path disposed between the central body and the outer tube;

a vane disposed in the air path, wherein the vane comprises:

a fuel inlet;

a fuel outlet; and a divider disposed in the vane axially between a downstream cavity having the fuel inlet and an upstream cavity having the fuel outlet; and a fuel path extending through the central body to the fuel inlet into the vane, wherein the fuel path extends through the vane in a non-straight direction about the divider from the fuel inlet to the fuel outlet, wherein the upstream cavity comprises a bypass adapted to channel fuel from the fuel path extending through the central body directly into the upstream cavity.

2. The system of claim 1, wherein the downstream cavity comprises another bypass adapted to channel fuel from the fuel path extending through the central body directly into the downstream cavity.

3. The system of claim 1, wherein the divider comprises a crossover passage through the divider, wherein the crossover passage is adapted to channel fuel from the downstream cavity directly into the upstream cavity.

4. The system of claim 1, wherein the vane is curved to create swirl in the air path.

5. The system of claim 1, wherein the central body comprises a fuel passage extending in a downstream axial direction and a reverse flow passage extending in an upstream axial direction, wherein the central body extends axially downstream away from the vane.

6. The system of claim 1, wherein the fuel outlet is angularly positioned on an outer surface of the vane.

7. The system of claim 1, comprising a combustor having the fuel nozzle, a turbine engine having the fuel nozzle, or a combination thereof.

8. The system of claim 1, wherein the fuel path extends through a substantial length of the vane in an upstream direction from the fuel inlet to the fuel outlet, and the upstream direction is generally opposite from a downstream direction of air flow along the air path.

9. A gas turbine fuel nozzle, comprising:

a central body comprising:

a multi-directional flow passage having a first flow passage configured to channel fuel in a first axial direction, and a second flow passage configured to channel fuel in a second axial direction opposite from the first axial direction;

an outer tube disposed about the central body;

an air path disposed between the central body and the outer tube;

a vane disposed in the air path, wherein the vane comprises:

a fuel inlet disposed in a downstream cavity of the vane relative to the first axial direction;

a fuel outlet disposed in an upstream cavity of the vane relative to the first axial direction;

a fuel path from the downstream cavity to the upstream cavity; and a bypass configured to channel fuel to the upstream cavity independent from the fuel path.

10. The gas turbine fuel nozzle of claim 9, wherein the bypass is configured to channel fuel from the multi-directional flow passage extending through the central body directly into the downstream cavity.

11. The gas turbine fuel nozzle of claim 9, wherein the bypass is configured to channel fuel from the multi-directional flow passage extending through the central body directly into the upstream cavity.

12. The gas turbine fuel nozzle of claim 11, comprising a second bypass configured to channel fuel from the multi-directional flow passage extending through the central body directly into the downstream cavity.

13. The gas turbine fuel nozzle of claim 9, comprising a divider disposed in the vane axially between the downstream cavity having the fuel inlet and the upstream cavity having the fuel outlet, wherein the divider routes the fuel path in a non-linear direction from the fuel inlet to the fuel outlet.

14. The gas turbine fuel nozzle of claim 13, wherein the divider comprises a crossover passage through the divider, wherein the crossover passage is adapted to channel fuel from the downstream cavity directly into the upstream cavity.

15. The gas turbine fuel nozzle of claim 9, wherein the vane comprises an airfoil shaped hollow body having the fuel inlet leading into the downstream cavity near a downstream tip of the vane, and the fuel path extends through the vane in the second axial direction along a substantial length of the vane.

16. A system, comprising:

a turbine fuel nozzle, comprising:

an air path through the turbine fuel nozzle;

a fuel path through the turbine fuel nozzle;

an air-fuel premixer disposed along the air path, wherein the air-fuel premixer comprises a swirl vane configured to swirl fuel and air in a downstream direction, wherein the swirl vane comprises:

a fuel inlet;

a fuel outlet; and a divider disposed in the swirl vane axially between a downstream cavity having the fuel inlet and an upstream cavity having the fuel outlet; and a fuel path extending through the turbine fuel nozzle to the fuel inlet into the swirl vane, wherein the fuel path extends through the swirl vane in a non-straight direction about the divider from the fuel inlet to the fuel outlet, wherein the turbine fuel nozzle comprises at least one of:

an upstream bypass adapted to channel fuel from the fuel path extending through the turbine fuel nozzle directly into the upstream cavity; or a downstream bypass adapted to channel fuel from the fuel path extending through the turbine fuel nozzle directly into the downstream cavity; or a crossover passage extending through the divider and adapted to channel fuel from the downstream cavity directly into the upstream cavity.

17. The system of claim 16, comprising at least one of the upstream bypass or the downstream bypass.

18. The system of claim 16, comprising the crossover passage.

19. A system, comprising:

a fuel nozzle, comprising:

a central body;

an outer tube disposed about the central body;

an air path disposed between the central body and the outer tube;

a vane disposed in the air path, wherein the vane comprises:

a fuel inlet;

a fuel outlet; and a divider disposed in the vane axially between a downstream cavity having the fuel inlet and an upstream cavity having the fuel outlet; and a fuel path extending through the central body to the fuel inlet into the vane, wherein the fuel path extends through the vane in a non-straight direction about the divider from the fuel inlet to the fuel outlet, wherein the downstream cavity comprises a bypass adapted to channel fuel from the fuel path extending through the central body directly into the downstream cavity.

20. The system of claim 19, wherein the vane is curved to create swirl in the air path.

21. The system of claim 19, wherein the central body comprises a fuel passage extending in a downstream axial direction and a reverse flow passage extending in an upstream axial direction, wherein the central body extends axially downstream away from the vane.

22. The system of claim 19, wherein the fuel outlet is angularly positioned on an outer surface of the vane.

23. The system of claim 19, comprising a combustor having the fuel nozzle, a turbine engine having the fuel nozzle, or a combination thereof.

24. The system of claim 19, wherein the fuel path extends through a substantial length of the vane in an upstream direction from the fuel inlet to the fuel outlet, and the upstream direction is generally opposite from a downstream direction of air flow along the air path.

25. A system, comprising:

a fuel nozzle, comprising:

a central body;

an outer tube disposed about the central body;

an air path disposed between the central body and the outer tube;

a vane disposed in the air path, wherein the vane comprises:

a fuel inlet;

a fuel outlet; and a divider disposed in the vane axially between a downstream cavity having the fuel inlet and an upstream cavity having the fuel outlet, wherein the divider comprises:

a crossover passage through the divider, and the crossover passage is adapted to channel fuel from the downstream cavity directly into the upstream cavity; and a fuel path extending through the central body to the fuel inlet into the vane, wherein the fuel path extends through the vane in a non-straight direction about the divider from the fuel inlet to the fuel outlet.

26. The system of claim 25, wherein the vane is curved to create swirl in the air path.

27. The system of claim 25, wherein the central body comprises a fuel passage extending in a downstream axial direction and a reverse flow passage extending in an upstream axial direction, wherein the central body extends axially downstream away from the vane.

28. The system of claim 25, wherein the fuel outlet is angularly positioned on an outer surface of the vane.

29. The system of claim 25, comprising a combustor having the fuel nozzle, a turbine engine having the fuel nozzle, or a combination thereof.

30. The system of claim 25, wherein the fuel path extends through a substantial length of the vane in an upstream direction from the fuel inlet to the fuel outlet, and the upstream direction is generally opposite from a downstream direction of air flow along the air path.

31. The system of claim 25, wherein the vane comprises a bypass adapted to channel fuel from the fuel path extending through the central body directly into the vane.

32. The system of claim 25, wherein the upstream cavity comprises the bypass adapted to channel fuel from the fuel path extending through the central body directly into the upstream cavity.

* * * * *